US006426472B1

(12) United States Patent
Carlson

(10) Patent No.: US 6,426,472 B1
(45) Date of Patent: Jul. 30, 2002

(54) PNEUMATIC SWITCH OPERATOR

(76) Inventor: David N. Carlson, 1462 Richards Ct., Eagan, MN (US) 55122

( * ) Notice: Subject to any disclaimer, the term of this patent is extended or adjusted under 35 U.S.C. 154(b) by 0 days.

(21) Appl. No.: 09/737,382

(22) Filed: Dec. 14, 2000

(51) Int. Cl.[7] ..... H01H 43/00
(52) U.S. Cl. ..... 200/33 R; 200/38 D
(58) Field of Search ..... 200/33 R, 19.01, 200/38 R, 38 F, 38 D, 38 E, 39 R, 40, 33 B, 33 D, 330, 331, 38 FB, 27 B, 81 R, 82 R

(56) References Cited

U.S. PATENT DOCUMENTS

| | | | | | |
|---|---|---|---|---|---|
| 3,184,560 | A | * | 5/1965 | Pittman, Jr. | 200/38 |
| 3,985,982 | A | | 10/1976 | Schneidinger | |
| 4,002,925 | A | | 1/1977 | Monahan | |
| 4,158,120 | A | * | 6/1979 | Pawlowski | 200/330 |
| 4,164,635 | A | * | 8/1979 | Finch et al. | 200/33 R |
| 4,360,739 | A | | 11/1982 | Goldstein | |
| 4,570,216 | A | | 2/1986 | Chan | |
| 4,645,942 | A | | 2/1987 | Nilssen | |
| 4,835,413 | A | | 5/1989 | Nilssen | |
| 4,972,045 | A | | 11/1990 | Primeau | |
| 5,051,550 | A | | 9/1991 | Harris | |
| 5,306,957 | A | | 4/1994 | Ellingham et al. | |
| 5,309,032 | A | | 5/1994 | Nilssen | |
| 5,397,869 | A | | 3/1995 | Huen | |
| 5,397,930 | A | | 3/1995 | Nilssen | |
| 5,471,022 | A | | 11/1995 | Kiss et al. | |
| 5,637,843 | A | | 6/1997 | Joyce et al. | |
| 5,719,362 | A | | 2/1998 | Gray, Jr. | |
| 5,828,018 | A | * | 10/1998 | Cooper | 200/33 R |
| 5,955,796 | A | | 9/1999 | Nilssen | |

* cited by examiner

*Primary Examiner*—Michael Friedhofer
*Assistant Examiner*—Lisa N. Klaus
(74) *Attorney, Agent, or Firm*—Nikolai & Mersereau, P.A.

(57) ABSTRACT

A self-contained pneumatic switch operating system for operating a conventional toggle switch is disclosed which includes a source of compressed air, a switch positioner including a linear pneumatic operator connected to the source of compressed air and to a pair of spaced switch operating members for operating a toggle switch situated therebetween. A housing for containing components of the switch operating system including a base member adapted to replace a conventional wall switch plate and a controller for controlling the operation of the switch positioner and a self-contained power supply for operating the switch positioner and the controller are also provided.

10 Claims, 2 Drawing Sheets

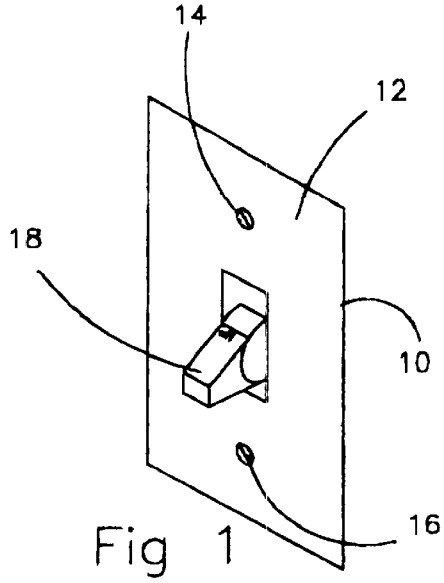
Fig 1
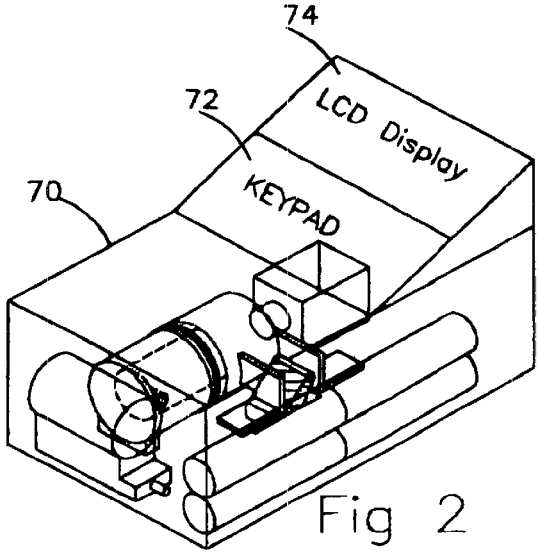
Fig 2
Fig 6
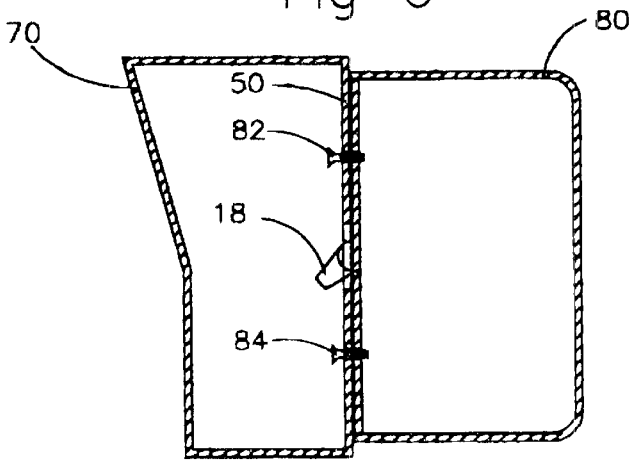

PNEUMATIC SWITCH OPERATOR

BACKGROUND OF THE INVENTION

I. Field of the Invention

The present invention relates generally to electrical switch operation, particularly timed auxiliary wall switch operators and, more particularly, to a self-contained programmable wall switch operating system for use with an existing conventional wall switch having a toggle operator. The system accomplishes automatic time-variable switch positioning with a compact low cost pneumatic system which also requires very little power to operate.

II. Related Art

The related art includes a variety of devices designed to actuate standard wall mounted, toggle operated light switches. One such device, shown and described in U.S. Pat. No. 3,985,982, features battery operated embodiments designed to fit over a conventional switch wall plate (FIGS. 3, 5 and 6) and features a solenoid-operated push/pull rod with manual override and an electrical or wind-up timer control. Examples of other such devices can be found in U.S. Pat. Nos. 4,002,925, 4,645,942, 5,306,957, 5,397,869 and 5,719,362. While these devices will operate a standard wall switch automatically, semi-automatically or replace a standard wall switch with an automatically operating device, they are all rather complicated with many designs requiring gears, linkages, springs and other moving parts which generally need to be made to close tolerances which, in turn, results in high parts cost and extensive labor to assemble. This is generally not the only drawback as these devices also require more than a practical amount of power to operate. Therefore, because of shortened battery life, they do not lend themselves to practical self-contained battery-operated retrofit designs.

The need for a low-cost, low power retrofit device to operate a conventional wall switch automatically on a time-variable positioning basis is unquestioned. Present systems which, for example, turn lights on and off at various times of the day to simulate occupancy for vacationing home owners, or the like, are expensive devices which must be plugged in between the appliance and the power source. Since most new homes are built with wall switches to control a variety of lights, the desirability of a low cost means available to automatically control one or more switches to accommodate vacationing homeowners and to turn on lights for those returning from a day at work would be very desirable. Furthermore, a self-contained device which requires only the removal of the two screws holding the switch plate, the lifting off of the existing cover and the installation of the device in position and refastening of the screws enables any homeowner to install an automatic switch operator without any special skills. It would also be very desirable for such a device to accomplish a very large number of operations on a single set of integral batteries.

Accordingly, it is a primary object of the present invention to provide a device for automatically operating a conventional wall switch on a timed basis.

It is a further object of the present invention to provide a device for automatically operating a conventional wall switch that is small and self contained and uses a minimum number of moving parts.

A still further object of the present invention is to provide a device for automatically operating a conventional wall switch that is relatively inexpensive to buy and requires very little power to operate.

Another object of the present invention is to provide such a device that is compact and requires little additional space.

Yet another object of the present invention is to provide such as device which can be installed on an existing switch without electrical connection by one unskilled in the electrical arts.

These and other objects and advantages of the present invention will become clear to those skilled in the art upon familiarization with the further descriptions contained herein, together with the appended drawings.

SUMMARY OF THE INVENTION

By means of the present invention, problems and drawbacks associated with prior automated add-on electrical wall toggle switch operating devices are solved by the provision of a low-cost, reliable automated switch operator that also features low power consumption so that a single set of batteries can last for hundreds of cycles. It is the combination of low cost, reduced complexity and operating power requirement that make the switch operating system of the present invention more practical than previous devices of the class.

The system of the present invention is a self-contained unit that carries its own low voltage power supply and housing including a bottom plate that carries system components and is designed to mount in lieu of or over a conventional switch plate or box cover using the same or a similar pair of attaching screws. Installation is easily accomplished by even an unskilled homeowner as no electrical connections are involved.

The switch operating system of the present invention features pneumatic operation and includes a pneumatic operator which utilizes a solenoid-controlled miniature air pump and cylinder which, in turn, operates a ram. The ram is linked both to the wall switch toggle and a mechanical spring-biased catch and repel mechanism which may be a magnetic touch latch device such that when the air cylinder extends, the toggle is operated to one position, for example the "ON" position and the latch spring is compressed in a latching mode. A solenoid is provided which closes and allows pressurization of the air cylinder when it is energized and vents the system when de-energized. The air cylinder and associated ram are caused to remain extended by the latch in its latching mode until the switch position is reversed even though air pressure is lost when the solenoid is de-energized. Upon a second pushing of the latch by the ram, the spring-loaded latch is put in a release or repel mode and the compressed latch spring is released which causes the ram to retract to its original starting position thereby reversing the position of the switch.

In this manner, electric power is necessary to "flip the switch" only in one direction and only a slight extension of the cylinder is required to activate the reversal of the latch. The unit further includes integral batteries, a programmable key pad and an LCD display so that the operation of the switch can be programmed in the manner of a night setback thermostat, or the like, the setting overridden or the device shut off, if desired.

It will be appreciated that the linear operating air cylinder and catch and repel mechanism or touch latch are the only moving parts in the system and they should operate reliably over thousands of cycles. Components of the system are all miniaturized and readily available commercially with the only modification necessary being the attachment of toggle-operating elements to the ram operated by the air cylinder.

BRIEF DESCRIPTION OF THE DRAWINGS

In the drawings wherein like numerals designate like parts throughout the same:

FIG. 1 is a perspective view of a conventional wall switch with flush-mounted plate;

FIG. 2 is a perspective view of a self-contained, programmable wall switch operating system and according with the present invention with a transparent housing showing placement of the internal parts;

FIG. 6 depicts a side elevational view partially in sections showing the programmable wall switch operating system mounted on a conventional switch box.

DETAILED DESCRIPTION

A detailed description will now be presented with reference to the several drawing figures. The embodiments shown and described are meant to illustrate the low-cost automated switch operating system of the invention and are presented by way of example and not limitation and it will be recognized by those skilled in the art that certain of the components can be replaced by other low-cost equivalents which also preserve the nature of the low power required to operate the system.

With this in mind, FIG. 1 depicts a familiar and highly conventional light switch and face plate, generally at 10, including a face plate or box cover 12 secured by screws 14 and 16 which hold the face plate to a switch box mounted in the wall as is well known in the art. The conventional, manually operated toggle is shown protruding through an opening in the plate 12 at 18.

Figure 3:
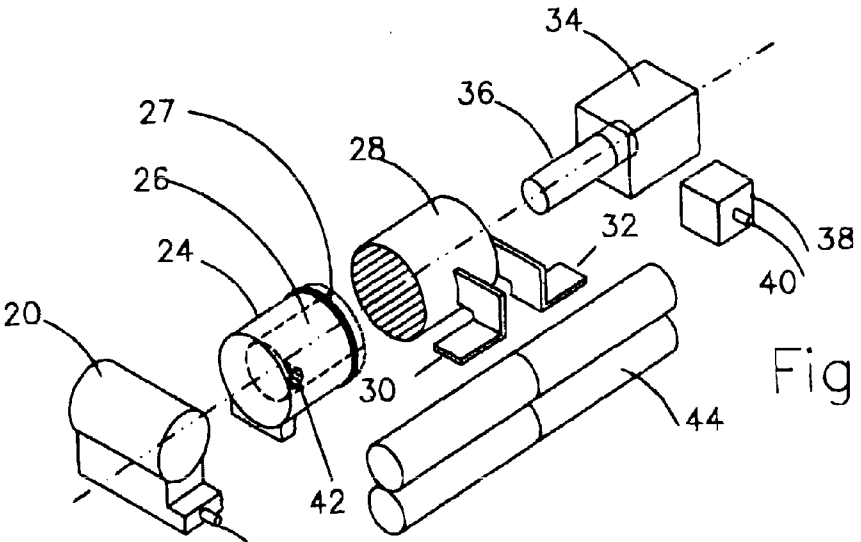
FIG. 3 is an exploded perspective view depicting the main elements of the pneumatic switch positioner of the invention.

In FIG. 3, the basic components of the toggle operating system of the automated electrical wall toggle switch operating device of the invention are shown in exploded relation. These include a micro-air pump 20 which may be a conventional micro-air pump such as those manufactured by Sensidyne, Inc. or other micro-size pump of the class. These devices are well known and are engineered to provide the performance of a larger pump on a miniature scale with low power consumption. An output connection is shown at 22. The system further includes an air cylinder 24 compatible with the air pump 20 and containing a bore 26 and O-ring 27 which seals a hollow ram device 28 which carries a pair of spaced shaped toggle operating members at 30 and 32.

Aligned with the ram 28 and cylinder 24 is a catch and repel mechanism 34 attached to the ram. It is preferably in the form of a single magnetic touch latch which may be of a type familiar to those in the cabinetry arts for catching and latching a cabinet door on a first push and automatically repelling (opening) the cabinet door upon a second push to an open position. Such devices are available commercially as from EPCO Company in Flint, Mich. An initial push on the associated piston 36 of the touch latch 34 causes the piston to retract and for the latch to assume and hold the latched or retracted position. A second pushing on the latch through piston 36 causes the latch to release and the spring to propel the piston 36 to an extended position thereby opening the latch. Thus, the cylinder 24 is required to operate the ram only in the extending direction and the touch switch operates the system in the reverse direction.

The system controls include an operating solenoid pictured at 38. Air connections 40 and 42 are shown on the solenoid and air cylinder respectively. Four conventional dry cells for powering the system are shown at 44 which provide the power for operating the toggle automated system of the invention. The solenoid 38 may also be a conventional commercially available TDS-V05B type electro-magnetic valve of a type widely used as fast exhaust valves on electronic medical devices.

Figure 5:
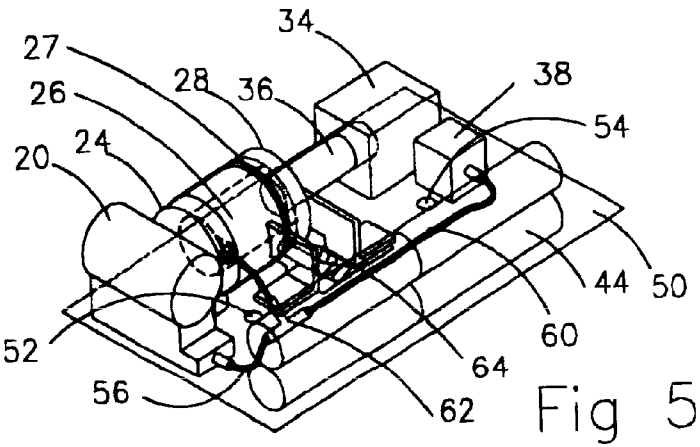
FIGS. 4 and 5 depict the pneumatic switch positioner of the invention as mounted with the upper portion of the housing missing and assembled with pneumatic connectors in the "ON" and "OFF" position, respectively.
Figure 4:
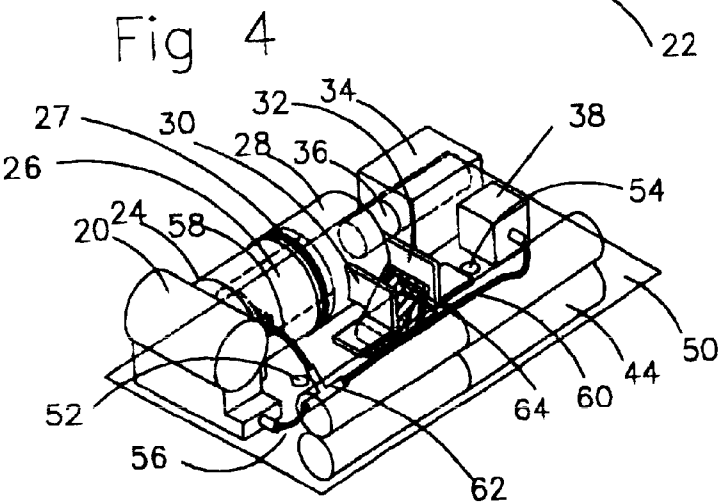

FIGS. 4 and 5 show the magnetic switch positioner of FIG. 3 assembled and a captured toggle in the "ON" and "OFF" positions, respectively. The components are shown mounted on a base or mounting plate 50 which is designed to be of a size to replace the plate 10 of FIG. 1 with the openings 52 and 54 based so as to be attachable again by screws as at 14 and 16 in FIG. 1. FIGS. 4 and 5 also include air or pneumatic lines 56, 58 and 60 with common T 62 interconnecting the pump 20, cylinder 24 and exhaust solenoid 38. A toggle is shown at 64. In FIG. 4, the toggle is shown in the "UP" or "ON" position with the cylinder 24 and hollow ram 28 fully extended and the touch latch 34 with piston 36 retracted. The toggle switch 64 is forced into the upward position by the shaped member 30 attached to the hollow ram 28.

In FIG. 5, the touch latch 34 is shown with piston 36 extended and the cylinder 24 with hollow ram 28 fully retracted. In this manner, member 32 operates to push the toggle 64 into the "DOWN" or "OFF" position. FIG. 2 shows the entire assembly with a housing cover 70 and including a conventional key pad for data entry in programming the device at 72 and an LCD display is shown at 74. The key pad and LCD output device are wired in conventional fashion through a micro-chip which can be used to program the operation of the solenoid and the pump to position the switch on demand as desired. The details of these are considered highly developed in many arts and can readily be implemented as necessary in manufacturing the device of the present invention.

FIG. 6 depicts the automated switch operating system of the invention mounted on a conventional switch box 80 by a pair of screws 82 and 84. The bottom mounting plate 50 has replaced the switch plate 12 of FIG. 1 on a conventional switch box.

It can be seen from the above that the unit of the present invention simply operates on air pressure which eliminates many mechanical linkages associated with prior art devices. Only the spring loaded latch piston 36 and the ram 28 are required to move.

In operation, when the timer activates the device calling for the switch to be turned on, the solenoid 38 closes and the micro-pump 20 is turned on by a conventional relay in the circuitry to provide air pressure which is directed via tubes 56 and 58 into the blind end of air cylinder 24. This causes the ram to extend forcing the piston 36 and the touch latch 34 to retract and the member 30 to operate the toggle 64 into the "ON" position. When the ram 28 reaches the end of its travel, the light will be in the "ON" position and the spring catch of the touch latch will be fully compressed which, in turn, locks the latch and the ram in this position. Thus, when the air pressure is lost, as the solenoid is de-energized while the switch is on, the touch latch will maintain the system in a status quo position. Upon a signal to turn the switch to the "OFF" position, the solenoid 38 again signals the pump to turn on momentarily so that the ram again pushes on the touch latch. This causes the touch latch to change to the release/repel mode releasing the catch spring and causing the piston 36 to extend. At the same time, the solenoid 36 is switched to the vent position allowing the air in the cylinder 34 to escape through line 60 being vented out of the solenoid. In this manner, the spring catch provides the energy to shut off the switch as the ram retracts and the member 32 pushes the switch into the "OFF" position as shown in FIG. 5 with the spring catch of the touch latch unlocked.

This invention has been described herein in considerable detail in order to comply with the Patent Statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A self-contained pneumatic switch operating system for operating a conventional toggle switch comprising:

(a) a source of compressed air;

(b) a switch positioner comprising a linear pneumatic operator connected to said source of compressed air and to a pair of spaced switch operating members for operating a toggle switch situated therebetween;

(c) a housing for containing components of the switch operating system including a base member adapted to replace a conventional wall switch plate;

(d) a controller for controlling the operation of the switch positioner; and (e) a self-contained power supply for operating said switch positioner and said controller.

2. A self-contained pneumatic switch operating system as in claim 1 wherein said source of compressed air is a miniature air pump.

3. A self-contained pneumatic switch operating system as in claim 1 wherein said switch positioner further comprises an air cylinder having a piston operating a ram and wherein said ram carries said spaced switch operating members.

4. A self-contained pneumatic switch operating system as in claim 3 wherein said air cylinder is a single acting cylinder and wherein said ram is connected between said piston and a spring-biased catch and repel mechanism.

5. A self-contained pneumatic switch operating system as in claim 4 in which the repel mechanism operates a switch in one direction.

6. A self-contained pneumatic switch operating system as in claim 1 wherein said controller includes a solenoid valve configured to operate said air pump and said pneumatic cylinder in a manner such that when said solenoid is energized, said air pump is energized and said air cylinder is extended in a power stroke and when said solenoid is de-energized, said air pump is de-energized and said air cylinder is vented.

7. A self-contained pneumatic switch operating system as in claim 6 wherein said power stroke is used to turn the switch to the "ON" position.

8. A self-contained pneumatic switch operating system as in claim 1 wherein said controller includes a programmable time-variable input for the timed control of the position of the switch.

9. A self-contained pneumatic switch operating system for operating a conventional toggle switch comprising:

(a) a miniature air pump for providing a source of compressed air;

(b) a switch positioner further comprising a single acting air cylinder having a piston connected to operate a ram, said ram further carrying a pair of spaced switch operating members for capturing and positioning a toggle switch;

(c) a spring-biased catch and repel mechanism for holding said ram in an extended position after a first power stroke in which a toggle switch is operated to a first position and causing said ram and said piston to retract after a second power stroke thereby operating a toggle switch to an opposite second position;

(d) a controller for controlling a operation of said switch positioner, said controller further comprising a solenoid valve for turning on said air pump when energized and turning off said air pump and venting said pump and cylinder when deenergized and timing means for timing the operation of said switch positioner;

(e) a source of DC power; and (f) a housing for containing components (a)–(e) of the switch operating system, said housing having a bottom plate adapted to replace a conventional switch plate without disturbing the switch.

10. A switch operating system as in claim 9 wherein said timer is programmable.

* * * * *